US008381347B2

(12) United States Patent
Grottodden

(10) Patent No.: US 8,381,347 B2
(45) Date of Patent: Feb. 26, 2013

(54) VACUUM ATTACHMENT FOR THE COLLECTION OF LIQUIDS

(76) Inventor: John P. Grottodden, Shoreview, MN (US)

( * ) Notice: Subject to any disclaimer, the term of this patent is extended or adjusted under 35 U.S.C. 154(b) by 383 days.

(21) Appl. No.: 12/634,139

(22) Filed: Dec. 9, 2009

(65) Prior Publication Data

US 2011/0131748 A1 Jun. 9, 2011

(51) Int. Cl.

| | |
|---|---|
| ***A47L 5/00*** | (2006.01) |
| ***A47L 7/00*** | (2006.01) |
| ***A47L 9/00*** | (2006.01) |
| ***A47L 9/10*** | (2006.01) |
| ***A47L 9/20*** | (2006.01) |
| ***A47L 9/02*** | (2006.01) |
| ***A47L 9/04*** | (2006.01) |
| ***A47L 9/06*** | (2006.01) |

(52) U.S. Cl. ..... 15/246.2; 15/353; 15/415.1; 15/375

(58) Field of Classification Search ..... 15/246.2, 15/414, 353, 415.1, 419, 420, 344, 400, 416, 15/421, 422, 422.1, 322, 375; 55/307, 355, 55/425, 429, DIG. 3; 119/611, 614

See application file for complete search history.

(56) References Cited

U.S. PATENT DOCUMENTS

| | | | | |
|---|---|---|---|---|
| 3,571,841 | A * | 3/1971 | Crouser | 15/401 |
| 3,946,458 | A * | 3/1976 | Creamer et al. | 15/339 |
| 4,179,769 | A * | 12/1979 | Lundquist | 15/353 |
| 4,341,540 | A * | 7/1982 | Howerin | 55/307 |
| 4,675,936 | A | 6/1987 | Rawlins | |
| 4,864,681 | A * | 9/1989 | Hult et al. | 15/367 |
| 5,263,224 | A * | 11/1993 | Lovelady | 15/353 |
| 5,377,383 | A * | 1/1995 | Christensen | 15/353 |
| 5,634,238 | A | 6/1997 | McCaffrey et al. | |
| 5,768,748 | A * | 6/1998 | Silvera et al. | 15/402 |
| 5,797,161 | A * | 8/1998 | Campbell | 15/322 |
| 5,974,624 | A * | 11/1999 | Eisen | 15/353 |
| 6,324,723 | B1 * | 12/2001 | Dodson et al. | 15/353 |
| 6,517,596 | B2 * | 2/2003 | Dodson et al. | 55/417 |
| 6,687,952 | B1 * | 2/2004 | Mohan, Jr. | 15/353 |
| 8,122,562 | B2 * | 2/2012 | Krebs | 15/320 |
| 2004/0200030 | A1 * | 10/2004 | Baer | 15/353 |
| 2004/0231093 | A1 * | 11/2004 | Oh | 15/353 |
| 2006/0042038 | A1 * | 3/2006 | Arnold et al. | 15/353 |
| 2006/0260089 | A1 * | 11/2006 | Hammond | 15/322 |
| 2007/0079474 | A1 * | 4/2007 | Min et al. | 15/353 |
| 2008/0216273 | A1 * | 9/2008 | Medema et al. | 15/246.3 |

* cited by examiner

*Primary Examiner* — Vanitha Elgart

(57) ABSTRACT

The invention provides a wet vacuum attachment, connecting to a hose of a commercially available vacuum cleaner that separates a liquid from a suction airstream created by the vacuum, so that the liquid does not enter the vacuum cleaner intake hose. The attachment can be manufactured as a single-part, having a suction port where the vacuum hose is attached, a suction passage to communicate with a reservoir in a region of low velocity for the separation and storage of the collected liquid, an inlet nozzle to increase the airstream velocity and to engage the working surface. In an additional embodiment, a filter media is inserted into a filter housing located in the region of low velocity between the suction passage and the reservoir to further prevent liquid from entering the vacuum hose.

13 Claims, 6 Drawing Sheets

VACUUM ATTACHMENT FOR THE COLLECTION OF LIQUIDS

BACKGROUND OF THE INVENTION

1. Field of Invention

This invention relates to a vacuum cleaner attachment that can pick up a liquid spill, while preventing the liquid from being drawn into the hose of the vacuum unit.

2. Related Art

It is difficult cleaning up wet spills, especially on carpet or upholstery. Methods for collecting solids like scrubbing or scraping are not suitable for removing moisture. Methods for removing moisture like absorption are not suitable for removing solids. Suction is the best method to accommodate the removal of both solids and liquid.

Inventors have created vacuums suitable for the collection and storage of wet solids and liquids. Several types of attachments have been invented which do not have their own suction motor.

The following attachments are comprised of multiple components, mainly having inlet and outlet pipes, and a reservoir which separates from a cover. [0008] U.S. Pat. No. 4,179,769 to Lundquist (1979), [0009] U.S. Pat. No. 4,341,540 to Howerin (1982)

Although the liquid separators of the above cited references allow the vacuum unit to remove liquid, the attachments tend to be bulky and stationary, limiting the useful range of the vacuum cleaner. Additionally, the attachments are located between the vacuum unit and the end of the hose, requiring manipulation of two separate hoses to connect and detach the separator.

It would therefore be desirable to have a portable vacuum cleaner attachment that can remove and separate liquid, and be easily detachable from the end of the vacuum hose. The following attachments meet that requirement:

U.S. Pat. No. 6,687,952 to Mohan, Jr. (2004),

U.S. Pat. No. 4,675,936 to Rawlins (1987),

U.S. Pat. No. 5,263,224 to Lovelady (1993),

U.S. Pat. No. 5,634,238 to McCaffrey et al. (1997),

U.S. Pat. No. 5,974,624 to Eisen (1999)

The above attachments all have one or more internal baffles or deflectors to form internal air passages, preventing manufacture as a single-part, causing a number of disadvantages:

a. They require the assembly of multiple components or the joining of 2 molded halves. Assembly is an extra step in the manufacturing process, making them more expensive to produce.

b. Assembly of the attachment as separate components requires thick material so that is holds its shape to that is can be fastened together.

c. Assembly also introduces tolerance problems in manufacturing, not present in a single-part design.

d. The completed attachments need to hold liquids, so designs requiring assembly must also provide a method of sealing the attachment.

e. If an attachment comprised of multiple components is dropped or is stored at a high temperature, causing deformation, it is more likely to fail in function or to leak than a single-part design.

f. They lack a filter to further prevent water droplets from the air stream to enter the vacuum hose.

OBJECTS AND ADVANTAGES

This invention is an attachment for a standard household vacuum, giving it the capability to suck up wet spills without contamination of the household vacuum. The novelty of this design is the simplicity of the single-part construction of the attachment, having no internal components, allowing this attachment to be manufactured at a lower cost than foreknown art and suitable for disposable applications.

Several objects and advantages of this invention are:

a. To provide a vacuum attachment that can remove and separate liquid, that is portable and can easily be attached to the end of a vacuum hose.

b. To prevent the separated liquid from being drawn into the hose of the vacuum unit.

c. To allow quick disposal of the collected liquid, not needing to be cleaned out for re-use, serving as a container for the disposal of its contents.

d. To be very low cost to manufacture, having thin material walls, requiring minimal assembly, allowing loose tolerances, not requiring a sealing process.

e. To be manufactured by existing processes for low-cost containers, such as blow molding, which have already been automated for high volume production.

f. To have reliability over temperature ranges and through rugged conditions.

g. To use the same end-of-life resources such as recycling or landfills as other disposable container products made with the same size, material and processes.

To complete the attachment for sanitary applications, an additional embodiment, a filter may be inserted into the attachment and the filter opening may be sealed with tape.

SUMMARY

The invention provides a wet vacuum attachment, connecting to a hose of a commercially available vacuum cleaner that separates a liquid from a suction airstream created by the vacuum, so that the liquid does not enter the vacuum cleaner intake hose. The attachment can be manufactured as a single-part, having a suction port where the vacuum hose is attached, a suction passage to communicate with a reservoir in a region of low velocity for the separation and storage of the collected liquid, an inlet nozzle to increase the airstream velocity and to engage the working surface. In an additional embodiment, a filter media is inserted into a filter housing located in the region of low velocity between the suction passage and the reservoir to further prevent liquid from entering the vacuum hose. In an additional embodiment, the reservoir is extended upward, forming a handle at the top of the attachment.

DRAWINGS

Figures

REFERENCE NUMERALS

11 handle

23 suction port

27 suction passage
21 reservoir [
54 inlet nozzle
31 filter housing
32 filter media

DETAILED DESCRIPTION—FIG. 1

Preferred Embodiment

Figure 1A:
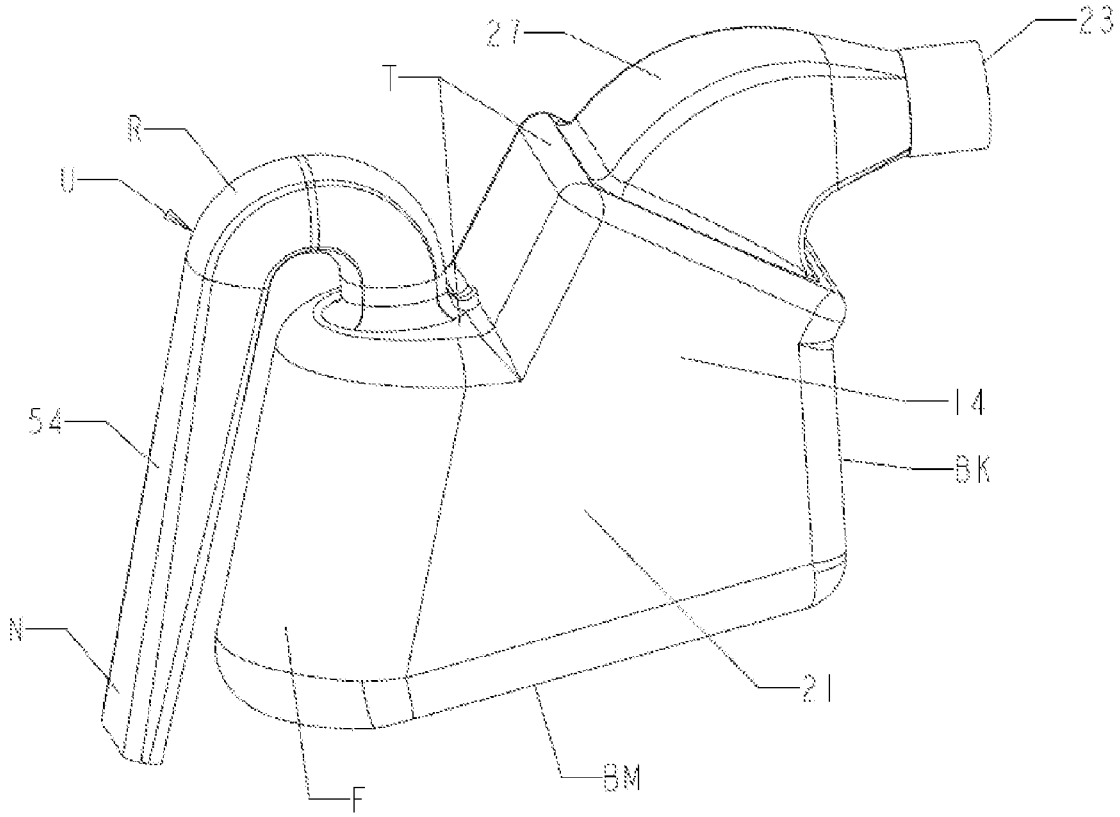
FIG. 1A shows a 3-dimensional view of the preferred embodiment.
Figure 1B:
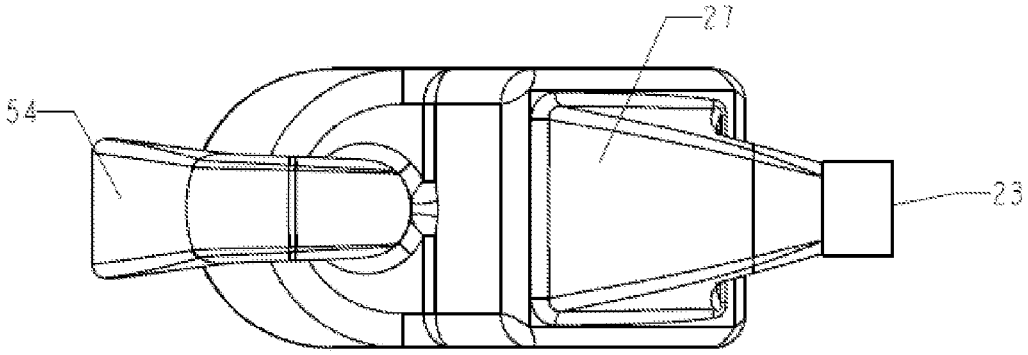
FIG. 1B shows a top view of the preferred embodiment.
Figure 1C:
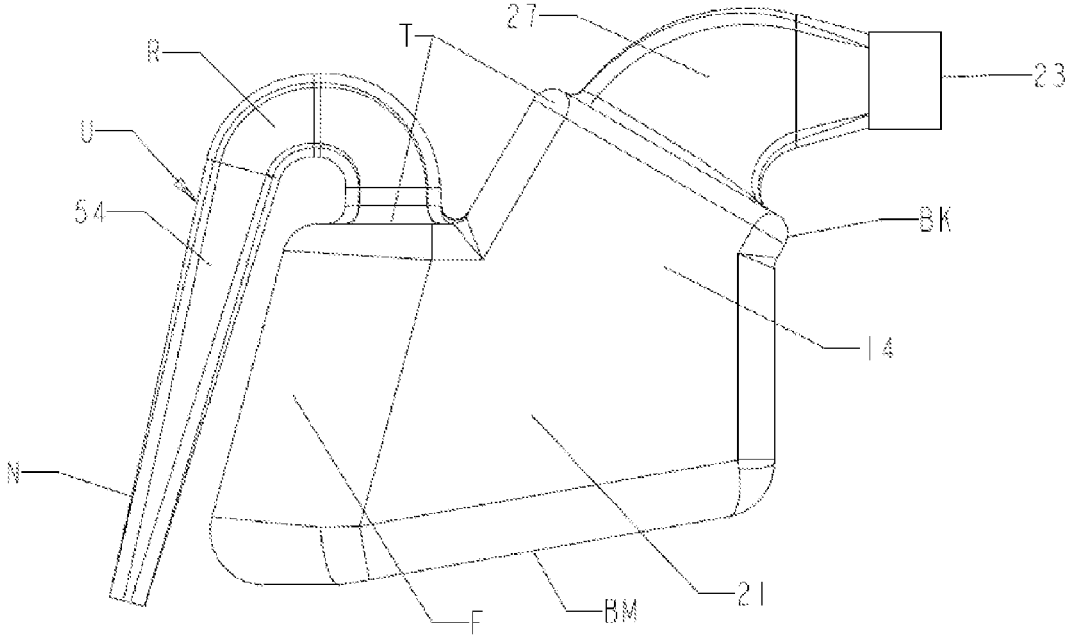
FIG. 1C shows a left view of the preferred embodiment.

As shown in FIG. 1A-C, the Vacuum Attachment for the Collection of Liquids comprises a reservoir 21, suction port 23, suction passage 27 and an inlet nozzle 54. Preferably, the attachment is manufactured as a single-part by a process such as blow molding. While described further later, FIGS. 2C and 3C show a cross section view of embodiments of the attachment that depict a wall structure of the single-part construction that forms the reservoir 21, suction port 23, suction passage 27, and inlet nozzle 54 and the pathway or mechanism through which liquid is removed (from the air) before reaching the suction port 23. The attachment may be composed of a transparent or translucent plastic, enabling the user to see the liquid level in the reservoir 21.

The suction port 23, is designed to receive a standard 1¼" vacuum hose. It is located on the top (T) of the attachment because gravity will pull any liquid in the attachment to the bottom (BM). Having the suction port 23 at the top (T) of the attachment is optimal to keep it away from the collected pool of liquid. The suction port 23 is located at the back (BK) of the attachment because it will keep the vacuum hose (not pictured) out of the spill, while the inlet nozzle 54, on the front (F) of the attachment contacts the spill.

The suction passage 27 allows a gradual and uniform transition of increased cross section and decreased airstream velocity from the suction port to the reservoir.

The reservoir 21 holds the collected liquid. Lower velocity in the reservoir 21 allows liquid from the air stream to have more time to drop into the reservoir. Slower moving air through the reservoir 21 will also prevent droplets from the collected liquid to be drawn into the suction port 23. The front (F) of the reservoir 21 is rounded so the agility of the inlet nozzle 54 is not limited by the presence of the reservoir. The bottom (BM) of the reservoir 21 is tapered at the front because it is intended that the user will be reaching downward, holding the attachment at an angle. With this taper, the reservoir will not drag against the working surface or contact the spill.

The inlet nozzle 54 is where the liquid spill enters the attachment when contacted with the working surface. The inlet nozzle 54 is sized to accommodate small chunks, clean a small area with a few passes and be able to get into corners, while maintaining adequate suction. As shown in at least FIGS. 1A-1C, inlet nozzle 54 has a generally U-shaped configuration (U) in which it transitions from a long and narrow cross section portion (N) where it contacts the spill, to a round cross section portion (R) where it interfaces the reservoir 21. With this shape, blockages are prevented without loss of suction because the minimum cross section dimension increases as the collected liquid travels to the reservoir.

In operation, a standard 1¼" vacuum hose (not shown) is inserted in the suction port 23 and the vacuum cleaner (not shown) is turned on. The suction created by the vacuum cleaner draws air through the attachment. The inlet nozzle 54 is passed over the liquid spill on the working surface to be cleaned. The liquid spill is sucked into the attachment and collected in the reservoir 21. When the spill has been cleaned or when the reservoir becomes full, the vacuum cleaner (not shown) is turned off and the vacuum hose (not shown) is disconnected. The attachment should be held in an upright position to prevent the collected liquid in the reservoir 21 from releasing through the inlet nozzle 54 or the suction port 23.

It is intended for the attachment to be disposed of with the collected liquid inside. Alternatively, the collected liquid can be emptied by turning the attachment upside-down and allowing the liquid to be released through the inlet nozzle 54 or the suction port 23. Alternatively, a removable plug (not shown) may be fitted into a hole (not shown) in the back of the reservoir to facilitate emptying the reservoir 21.

While certain embodiments have been described in detail and shown in the accompanying drawings, it is to be understood that such embodiments are merely illustrative of and not restrictive on the broad invention. This invention may not be limited to the specific constructions and arrangements shown and described, since various modifications may occur to those ordinarily skilled in the art.

DETAILED DESCRIPTION—FIG. 2

Additional Embodiment

Figure 2A:
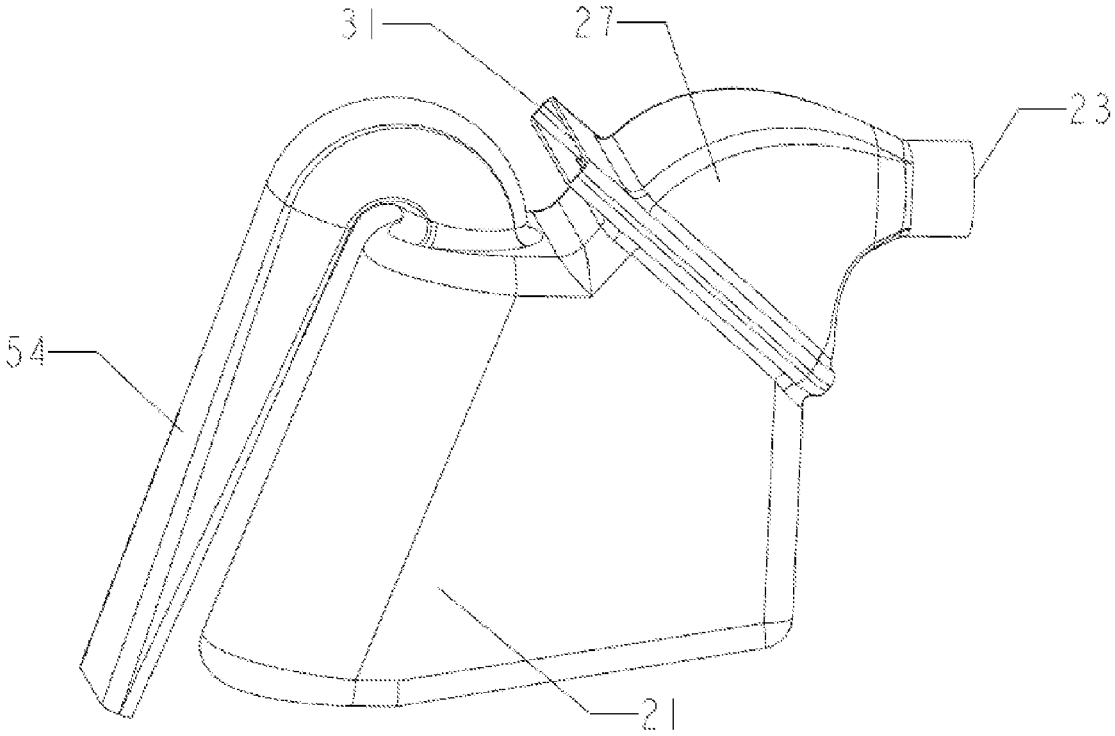
FIG. 2A shows a 3-dimensional view of an additional embodiment.
Figure 2B:
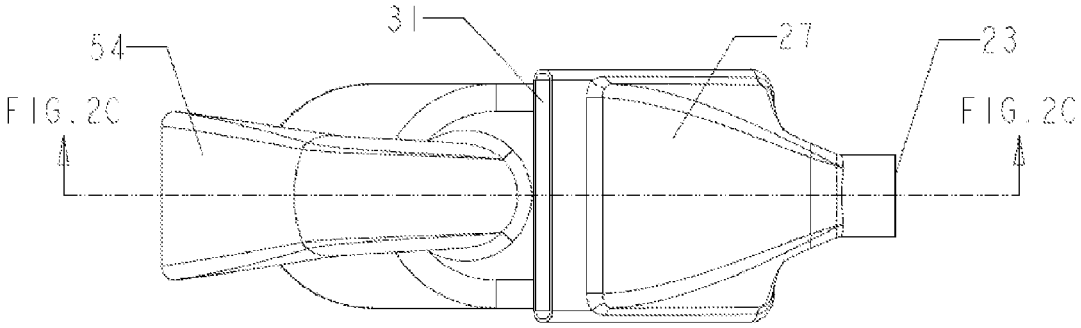
FIG. 2B shows a top view of an additional embodiment.
Figure 2C:
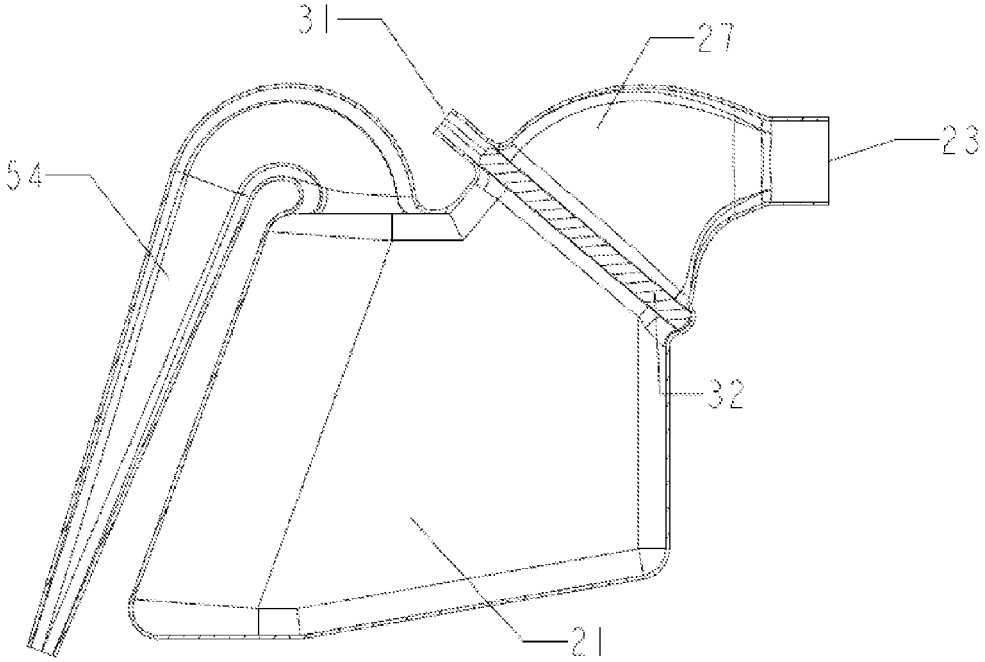
FIG. 2C shows a left cross section view of an additional embodiment having a filter installed.

As shown in FIG. 2A-C, the additional embodiment of the Vacuum Attachment for the Collection of Liquids comprises of the same features as the preferred embodiment, but with a filter media 32 inserted into a filter housing 31.

The filter housing 31 is a portion of the attachment with an opening for the filter media 32 to be inserted. The filter housing 31 has restrictions above and below the filter media 32, preventing it from dropping into the reservoir or being sucked into the suction passage 27. The filter housing 31 is sized to accommodate the filter media 32, which has a larger cross section than the suction port 23. A larger filter results in a more efficient filter, allowing less suction loss and requiring less work to maintain the flow of air through it.

The filter housing 31 is positioned to hold the filter in an orientation to minimize the amount of water droplets from the airstream reaching the filter media 32. The water droplets that do reach the filter media 32 are collected by the filter media 32 and accumulate there. If the filter media 32 reaches saturation, the collected liquid runs out. The design allows this run-off to return to the reservoir 21 instead to passing into the suction port 23.

The filter media 32 could be any suitable filter material, as simple as a piece of polyurethane foam. The selected material for the filter media 32 is capable of filtering water droplets without losing suction. When the attachment is manufactured, the filter media 32 may be inserted into the filter housing 31. A piece of tape (not shown) may be applied to seal the opening in the filter housing 31.

DETAILED DESCRIPTION—FIG. 3

Additional Embodiment

Figure 3A:
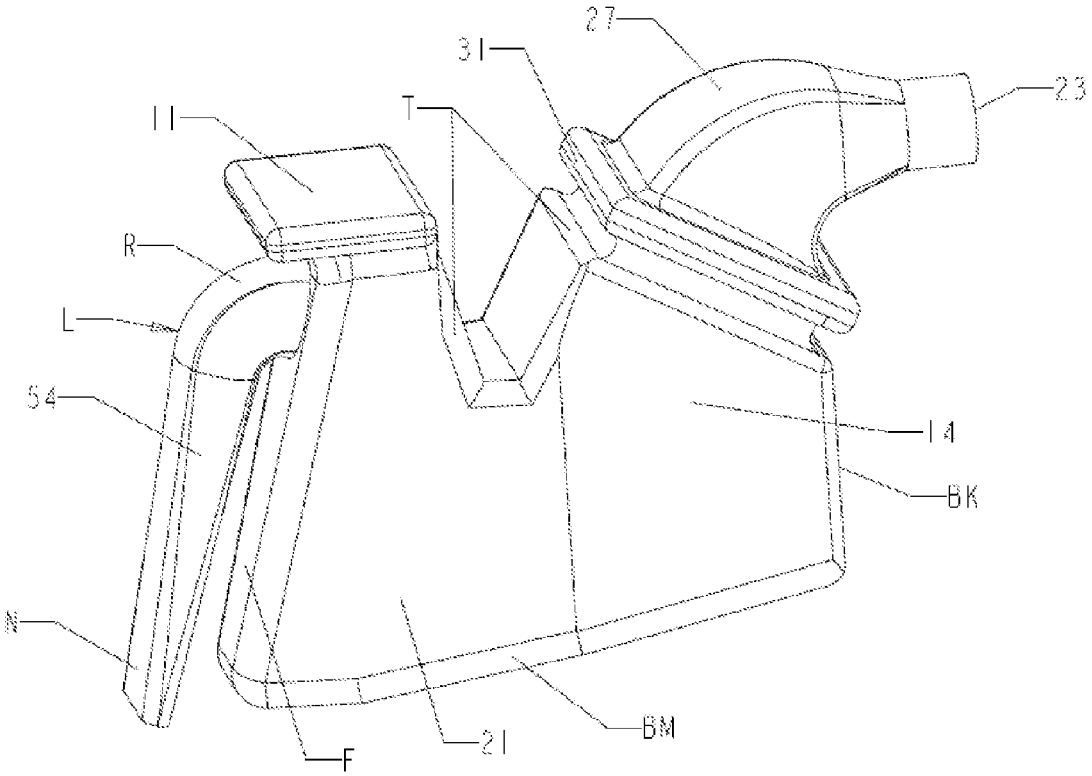
FIG. 3A shows a 3-dimensional view of an additional embodiment.
Figure 3B:
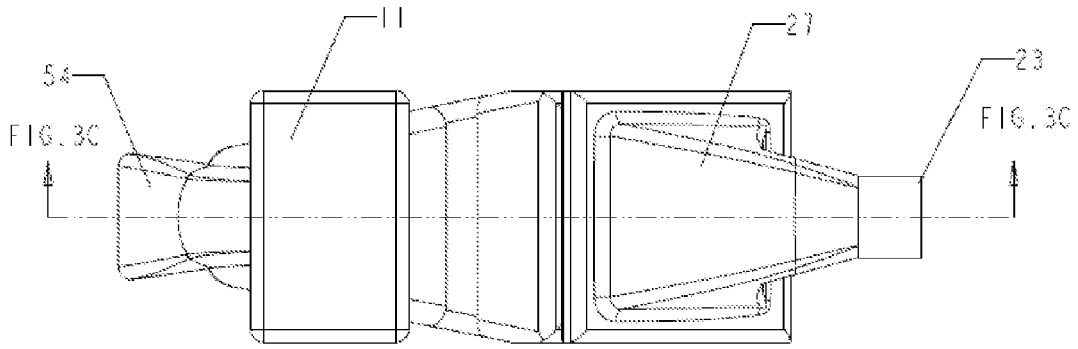
FIG. 3B shows a top view of an additional embodiment.
Figure 3C:
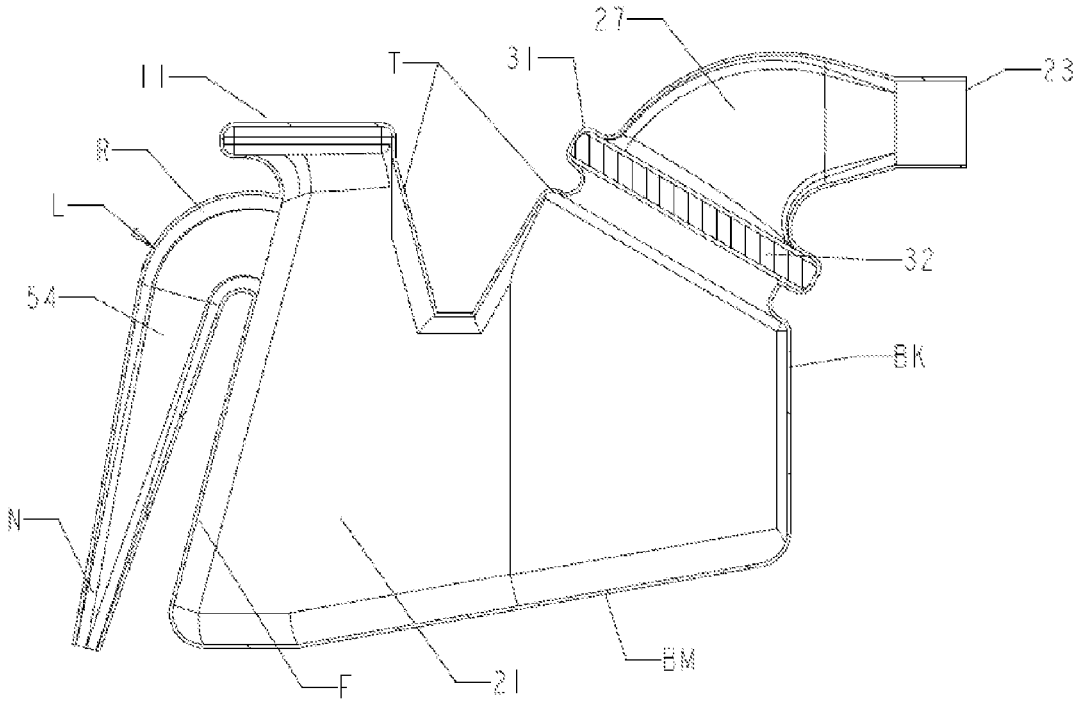
FIG. 3C shows a left cross section view of an additional embodiment having a filter installed.

As shown in FIG. 3A-C, the additional embodiment of the Vacuum Attachment for the Collection of Liquids comprises of the same features as the preferred embodiment, but the reservoir 21 extends upward, forming a handle 11 at the top (T) front (F) of the attachment. The inlet nozzle 54 connects into the front (F) of the reservoir 21, providing a generally L-shaped configuration (L) as shown in FIGS. 3A-3C instead of the generally U-Shaped configuration shown in embodiments of FIGS. 1A-2C.

What is claimed is:

1. An attachment for a vacuum cleaner having a hose providing an airstream to remove liquid from a surface, the attachment comprising:

a single-part container defining a structure lacking internal baffle components and internal deflector components, the container including:

a reservoir to receive the liquid, the reservoir including a bottom side, a top side, a front side, and a first cross sectional area;

a suction port adapted to be coupled to the hose, positioned adjacent the top side of reservoir, and having a second cross sectional area;

an inlet nozzle having a third cross sectional area, interfacing with and in communication with the reservoir, and including a portion extending generally downward relative to the top side of the reservoir to collect the liquid from the surface, wherein a portion of the inlet nozzle is spaced apart a predetermined distance from the reservoir, wherein the first cross sectional area of the reservoir is larger than the second cross sectional area of the suction port and larger than the third cross sectional area of the inlet nozzle to cause an air flow velocity in the reservoir to be slower than an air flow velocity in the inlet nozzle and an air flow velocity in the suction port.

2. The attachment of claim 1, comprising:

a filter housing positioned between the top side of the reservoir and the suction port, wherein the filter housing is configured to removably receive a filter media larger than the second cross sectional area of the suction port.

3. The attachment defined in claim 1 in which a handle is formed at the top side of the reservoir.

4. The attachment of claim 1, wherein the inlet nozzle interfaces with and communicates with the top side of the reservoir such that the portion of the inlet nozzle extending generally downward at least partially defines a generally U-shaped member.

5. The attachment of claim 1, wherein the inlet nozzle interfaces with and communicates with the front side of the reservoir such that the portion of the inlet nozzle extending generally downward at least partially defines a generally L-shaped member.

6. The attachment of claim 1, comprising:

a suction passage spaced a predetermined distance above the bottom side of the reservoir to be positioned at the top side of the reservoir between the reservoir and the suction port to provide communication between the reservoir and the suction port, wherein the suction passage defines a decreasing cross sectional area from the reservoir to the suction port.

7. The attachment of claim 2, comprising:

a filter media is made of a material configured to maintain a vacuum suction through the filter media while preventing passage of liquid through the filter media.

8. An attachment for a vacuum cleaner having a hose providing an airstream to remove liquid from a surface, the attachment comprising:

a single-part container defining a structure lacking internal baffle components and internal deflector components, the container including:

a reservoir to receive the liquid, the reservoir including a bottom side, a front side, a top side, and a back side, wherein the reservoir includes a first cross sectional area corresponding to a first velocity region;

a suction port adapted to be coupled to the hose, positioned adjacent to the top side and the back side of the reservoir, and defining a second cross sectional area;

a suction passage spaced a predetermined distance from the bottom side of the reservoir and positioned between the reservoir and the suction port to provide communication between the reservoir and the suction port, wherein the suction passage defines a decreasing cross sectional area from the reservoir to the suction port;

a filter housing positioned between the top side of the reservoir and the suction passage, the filter housing configured to removably receive a filter media having a fourth cross sectional area larger than the third cross sectional area of the suction port; and an inlet nozzle including a first portion interfacing with and in communication with the reservoir and a second portion extending generally downward from the first portion to collect the liquid from the surface, wherein the second portion is spaced a predetermined distance from the bottom side of the reservoir, wherein the first cross sectional area of the reservoir is larger than the second cross sectional area of the suction port and larger than the third cross sectional area of the inlet nozzle to cause an air flow velocity in the reservoir to be slower than the air flow velocity in the inlet nozzle and the air flow velocity in the suction port.

9. The attachment of claim 8, wherein the second portion extends generally downward from the top side of the reservoir so that the inlet nozzle defines a generally U-shaped member.

10. The attachment of claim 8 wherein the first portion of the inlet nozzle extends from a front side of the reservoir and the second portion extends generally downward to collect the liquid such that the first and second portions define the inlet nozzle as a generally L-shaped member.

11. An attachment for a vacuum cleaner having a hose providing a vacuum-based airstream, the attachment, comprising:

a single-part container including:

a reservoir to receive the liquid, the reservoir including a bottom side, a top side, a front side, and a first cross sectional area;

a suction port adapted to be coupled to the hose, positioned adjacent the top side of reservoir, and having a second cross sectional area;

a suction passage spaced a predetermined distance from the bottom side of the reservoir to be positioned at the top side of the reservoir between the reservoir and the suction port to provide communication between the reservoir and the suction port, wherein the suction passage defines a decreasing cross sectional area from the reservoir to the suction port; and an inlet nozzle interfacing with and in communication with the reservoir and including a portion that extends generally downward relative to the top side of the reservoir to collect liquid from a surface external to the attachment and that is spaced a predetermined distance from the bottom side of the reservoir, wherein the inlet nozzle includes a third cross sectional area, wherein the first cross sectional area of the reservoir is larger than the second cross sectional area of the suction port and larger than the third cross sectional area of the inlet nozzle to cause an air flow velocity in the reservoir to be slower than an air flow velocity in the inlet nozzle and an air flow velocity in the suction port, wherein a wall structure forming the inlet nozzle, reservoir, and suction port of the container exclusively defines a liquid removal mechanism to remove liquid from the airstream within the reservoir to cause collection of the liquid within the reservoir.

12. An attachment for a vacuum cleaner having a hose providing a vacuum-base airstream, the attachment comprising:

a single-part container including:

a reservoir to receive the liquid, the reservoir including a bottom side, a top side, a front side, and a first cross sectional area;

a suction port adapted to be coupled to the hose, positioned adjacent the top side of reservoir, and having a second cross sectional area;

an inlet nozzle interfacing with and in communication with the reservoir and including a portion that extends generally downward relative to the top side of the reservoir to collect liquid from a surface external to the attachment and that is spaced a predetermined distance from the bottom side of the reservoir, wherein the inlet nozzle includes a third cross sectional area; and a filter housing positioned between the top side of the reservoir and the suction port at a second region of air velocity lower than a third region of air velocity at the suction port, the filter housing configured to removably receive a filter media having a fourth cross sectional area larger than the second cross sectional area of the suction port, wherein the filter media is configured to prevent passage of liquid through the suction port, wherein the first cross sectional area of the reservoir is larger than the second cross sectional area of the suction port and larger than the third cross sectional area of the inlet nozzle to cause an air flow velocity in the reservoir to be slower than an air flow velocity in the inlet nozzle and an air flow velocity in the suction port, and wherein a wall structure forming the inlet nozzle, reservoir, and suction port of the container exclusively defines a liquid removal mechanism to remove liquid from the airstream within the reservoir to cause collection of the liquid within the reservoir.

13. An attachment for a vacuum cleaner having a hose providing a vacuum-based airstream, the attachment comprising:

a single-part container including:

a reservoir to receive the liquid, the reservoir including a bottom side, a top side, a front side, and a first cross sectional area;

a suction port adapted to be coupled to the hose, positioned adjacent the top side of reservoir, and having a second cross sectional area; and an inlet nozzle interfacing with and in communication with the reservoir and including a portion that extends generally downward relative to the top side of the reservoir to collect liquid from a surface external to the attachment and that is spaced a predetermined distance from the bottom side of the reservoir, wherein the inlet nozzle includes a third cross sectional area, wherein the first cross sectional area of the reservoir is larger than the second cross sectional area of the suction port and larger than the third cross sectional area of the inlet nozzle to cause an air flow velocity in the reservoir to be slower than an air flow velocity in the inlet nozzle and an air flow velocity in the suction port, wherein a wall structure forming the inlet nozzle, reservoir, and suction port of the container exclusively defines a liquid removal mechanism to remove liquid from the airstream within the reservoir to cause collection of the liquid within the reservoir, and wherein the wall structure of the single part container is formed without internal baffle components and internal deflector components.

* * * * *